US010400467B2

(12) United States Patent
Pichon et al.

(10) Patent No.: US 10,400,467 B2
(45) Date of Patent: Sep. 3, 2019

(54) SWIMMING POOL CLEANING DEVICE WITH OBSTACLE CLEARING SYSTEM

(71) Applicant: ZODIAC POOL CARE EUROPE, Paris (FR)

(72) Inventors: Philippe Pichon, Villeneuve de Riviere (FR); Philippe Blanc Tailleur, Toulouse (FR); Louis Favie, Colomiers (FR)

(73) Assignee: ZODIAC POOL CARE EUROPE, Bron (FR)

( * ) Notice: Subject to any disclaimer, the term of this patent is extended or adjusted under 35 U.S.C. 154(b) by 227 days.

(21) Appl. No.: 15/331,609

(22) Filed: Oct. 21, 2016

(65) Prior Publication Data

US 2017/0114561 A1 Apr. 27, 2017
US 2018/0283028 A9 Oct. 4, 2018

Related U.S. Application Data

(63) Continuation of application No. PCT/FR2016/052708, filed on Oct. 20, 2016.

(30) Foreign Application Priority Data

Oct. 21, 2015 (FR) ..... 15 60038

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/16
USPC ..... 15/1.7
See application file for complete search history.

(56) References Cited

U.S. PATENT DOCUMENTS 5,172,445 A † 12/1992 Chandler
5,197,158 A 3/1993 Moini
8,393,029 B2 * 3/2013 Pichon ..... E04H 4/1654 15/1.7

FOREIGN PATENT DOCUMENTS

EP 1277897 1/2003
EP 1785552 A2 * 5/2007 ..... E04H 4/1263
FR 2584442 1/1987

(Continued)

OTHER PUBLICATIONS

French Patent Application No. 1560038, French Search Report, dated Aug. 15, 2016, 8 pages.
EP16809461.3, "Office Action", dated Feb. 13, 2019, 5 pages.

*Primary Examiner* — Laura C Guidotti
(74) *Attorney, Agent, or Firm* — Kilpatrick Townsend & Stockton LLP; Dean W. Russell

(57) ABSTRACT

The invention is directed to a swimming pool cleaning device comprising:

a body, means for driving and guiding the body comprising at least two pairs of wheels: front wheels and rear wheels, characterized in that the drive means of the device further include:

an intermediate wheel turning about a rotation axis disposed between the front wheel and the rear wheel on at least one of the two sides of the device, the diameter and the position of the rotation axis of this intermediate wheel being such that said wheel does not touch the guide plane XrYr when the robot is resting on the latter, said guide plane XrYr being defined by the points of contact of the front and rear wheels with the ground.

18 Claims, 5 Drawing Sheets

(56) References Cited

FOREIGN PATENT DOCUMENTS

| | | |
|---|---|---|
| WO | 2011161389 | 12/2011 |

* cited by examiner
† cited by third party

SWIMMING POOL CLEANING DEVICE WITH OBSTACLE CLEARING SYSTEM

CROSS-REFERENCE TO RELATED APPLICATIONS

This application claims the benefit of and priority to French Patent Application No. 15 60038, titled "Appareil Nettoyeur de Piscine a Dispositif de Franchissement D'Obstacle" and filed Oct. 21, 2015 and is a continuation of International Patent Application No. PCT/FR2016/052708 titled "Swimming Pool Cleaning Apparatus Comprising an Obstacle Clearance Device" and filed Oct. 20, 2016.

The present invention is in the field of swimming pool equipment. It more particularly concerns a robot type autonomous swimming pool cleaning device.

PREAMBLE AND PRIOR ART

The invention concerns a device for cleaning a surface immersed in a liquid, such as a surface formed by the walls of a pool, notably a swimming pool. It is notably a mobile swimming pool cleaning robot. A cleaning robot of this kind cleans as it travels over the bottom and the walls of the swimming pool, brushing the walls, and aspirating the debris toward a filter. By debris is meant all the particles present in the pool, such as leaf fragments, microalgae, etc., this debris normally being deposited on the bottom of the pool or stuck to the side walls thereof.

The robot is most commonly fed with energy by an electrical cable connecting the robot to an external control and power supply unit.

There are known in this field, for example, the applicant's patents FR 2 925 557 and 2 925 551 directed to an immersed surface cleaning device with demountable filter system. Such systems comprise a body, members for driving said body over the immersed surface and a filter chamber inside the body including a liquid inlet, a liquid outlet and a hydraulic circuit in which the liquid circulates between the inlet and the outlet via a filter system.

Also known in this field is the applicant's patent application WO201161389 which discloses a swimming pool cleaning device including a member projecting from its base fastened to a rotary anti-immobilizing member positioned at the front in terms of the direction of movement of the device. If the anti-immobilizing member encounters an obstacle on the guide plane of the device, it abuts against the obstacle, which forces said anti-immobilizing member to rotate, thus rolling over the obstacle, at the same time as causing it to rise toward the base of the device with the projecting member, thus avoiding the projecting member being immobilized by the obstacle.

Also known in the same field is U.S. Pat. No. 5,197,158 the subject matter of which is a swimming pool cleaning device comprising floats that make it possible to change the direction of movement of the device by changing position after the device collides with an obstacle or after the device encounters a vertical wall of the pool. The device also includes a member for laterally lifting the device that projects from the base of the device and lifts the device laterally when it changes its direction of movement and therefore makes it possible to impart to it a trajectory line different from that which it had just before the change of direction of movement.

Also known is patent application FR 2 584 442 directed to a swimming pool cleaning device also including a member for laterally lifting the body of the device which laterally lifts said device from the guide plane when the device changes its direction of movement so as to impart to it a trajectory line different from that it had just before the change of direction of movement.

It has been found that these robots frequently experience difficulties in clearing obstacles on the bottom of the swimming pool, notably when those obstacles lead to loss of contact of one of the wheels of the robot drive and guiding means with the surface over which the robot is moving.

An object of the invention is notably to remedy this drawback.

SUMMARY OF THE INVENTION

A first aspect of the invention is directed to a swimming pool cleaning device

- a body,
- means for driving and guiding the body comprising at least two pairs of wheels: front wheels and rear wheels.

The drive means of the device further include:

- an intermediate wheel turning about a rotation axis disposed between the front wheel and the rear wheel on at least one of the two sides of the device, the diameter and the position of the rotation axis of this intermediate wheel being such that said wheel does not touch the guide plane XrYr when the robot is resting on the latter, said guide plane XrYr being defined by the points of contact of the front and rear wheels with the ground.

"Swimming pool cleaning device" refers to a device for cleaning an immersed surface, that is to say typically a device, mobile in or over the bottom of a swimming pool, and adapted to filter debris deposited either on the bottom or on a wall. A device of this kind is commonly referred to as a swimming pool cleaning robot when it includes means for automated management of the movements on the bottom and over the walls of the swimming pool to cover all the surface to be cleaned.

The use of an intermediate wheel turning about a rotation axis disposed between the front and rear wheels on at least one of the two sides of the device and not touching the guide plane XrYr when the robot is resting on the latter makes it possible, if at least one of the front or rear wheels is no longer in contact with the ground (the surface over which the robot is moving) because of clearing an obstacle, for the intermediate wheel to come into contact with said obstacle and this facilitates clearing it. The intermediate wheel forms part of the drive means and is driven in rotation about its rotation axis by a motor of the cleaning device.

The effect of the invention is therefore to make it possible for intermediate drive means to bear on and to push an obstacle crossing the tangential plane of contact of the front and rear wheels with the ground (this plane being the plane of contact of the wheels with the ground in the absence of an obstacle to be cleared), to facilitate clearing it.

Another advantage of a swimming pool cleaning device of this kind is that, given that the intermediate wheel is in contact with the surface over which the robot is moving only in situations where the device encounters an obstacle on said surface, the cleaning device has a lower energy consumption than the same cleaning device with all the wheels (including the intermediate wheel) in contact with said surface at all times.

The invention also concerns an immersed surface cleaning device characterized in combination by some or all of the features referred to above or hereinafter.

In one particular embodiment, the rotation axis about which the intermediate wheel is articulated is parallel to the transverse axis Yr, which corresponds to the drive axis of the front and rear wheels. In another particular embodiment, the rotation axis about which the intermediate wheel is articulated is not parallel to the transverse axis Yr.

In one particular embodiment, the rotation axis of the intermediate wheel is situated in the plane defined by the rotation axes of the front and rear wheels.

In one particular embodiment, the intermediate wheel is longitudinally situated practically halfway between the front and rear wheels.

In one particular embodiment, the intermediate wheel includes on its circumference a substantially cylindrical friction area having a non-slip surface state.

In one particular embodiment, the intermediate wheel is driven in rotation thanks to an internal gear area of said wheel of smaller diameter than the friction area, this gear area cooperating with a gear itself driven by the rear wheel or the front wheel.

In one particular embodiment, the gear area of the intermediate wheel cooperates with two gears driven by the rear and front wheels.

In one particular embodiment, the intermediate wheel is driven by the gears at a speed different from the front and rear wheels.

In one particular embodiment, the intermediate wheel turns in the same direction as the front and rear wheels, this intermediate wheel having a rotation speed such that the tangential speed of the friction area is substantially equal to that of the front and rear wheels.

In one particular embodiment, the intermediate wheel turns in the same direction as the front and rear wheels, this intermediate wheel having a rotation speed such that the tangential speed of the friction area is lower than that of the front and rear wheels. A lower speed makes it possible to reduce any slipping of the intermediate wheel on the object to be cleared.

In one particular embodiment, the driving means of the cleaning device include an intermediate wheel on each side of the body.

In one particular embodiment, the friction area includes at least one projection forming a lug adapted to bear on an obstacle situated on the bottom of the swimming pool to facilitate said cleaning device clearing it.

In one particular embodiment, the intermediate wheel turns about an eccentric rotation axis. In an embodiment of this kind, the intermediate wheel still does not touch the guide plane XrYr when the robot is resting on the latter.

In one particular embodiment, the drive means of the swimming pool cleaning device include an intermediate wheel on each side of the body, these intermediate wheels having different diameters and/or rotation speeds.

DESCRIPTION OF THE FIGURES

The features and advantages of the invention will be better understood thanks to the following description, which sets out the features of the invention via a nonlimiting application example.

The description is supported by the appended figures, in which.

DETAILED DESCRIPTION OF ONE EMBODIMENT OF THE INVENTION

The invention finds a place in a swimming pool technical environment, for example a family type below-ground swimming pool.

In the present embodiment, an immersed surface cleaning system includes a cleaning device 10, referred to hereinafter as a swimming pool cleaning robot, and a power supply and control unit of said swimming pool cleaning robot (not shown in the figures). In a variant, this power supply and control unit may be integrated into the cleaning device.

Figure 1:
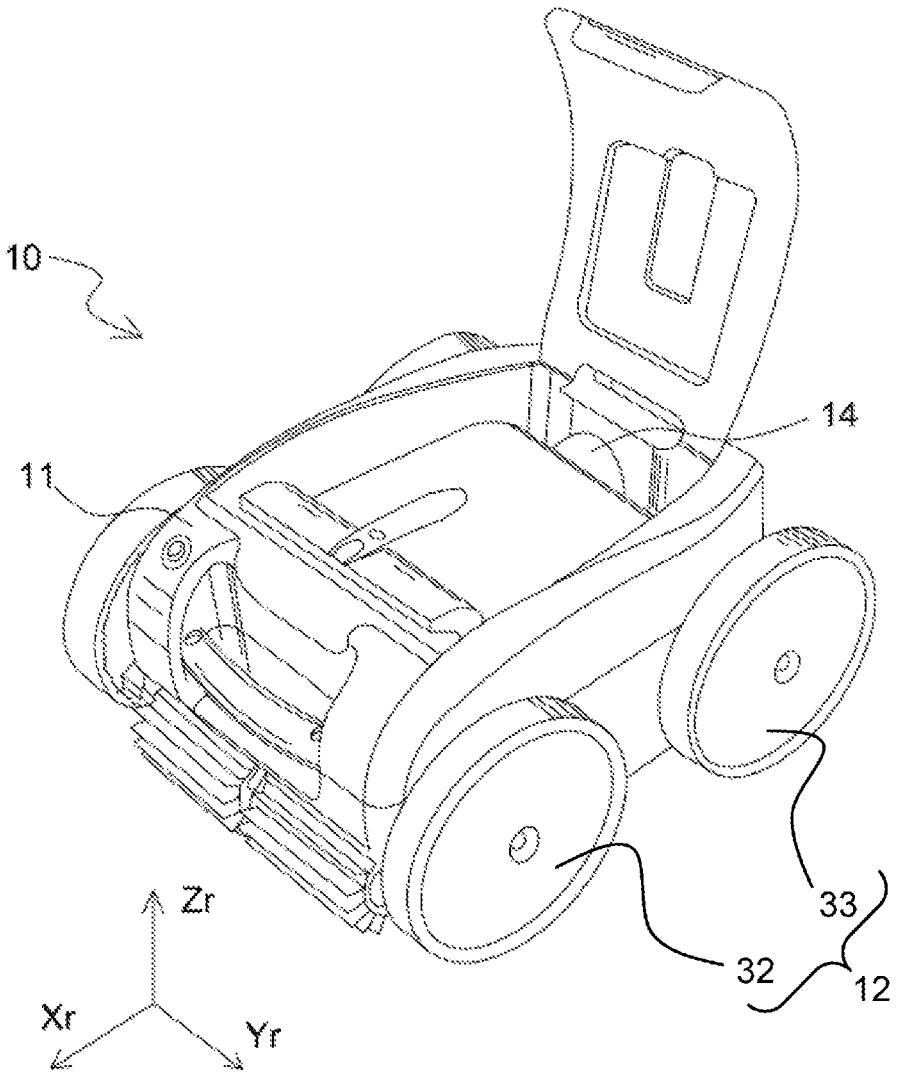
FIG. 1 shows a perspective view of a swimming pool cleaning device employing a filter system as described.
Figure 2:
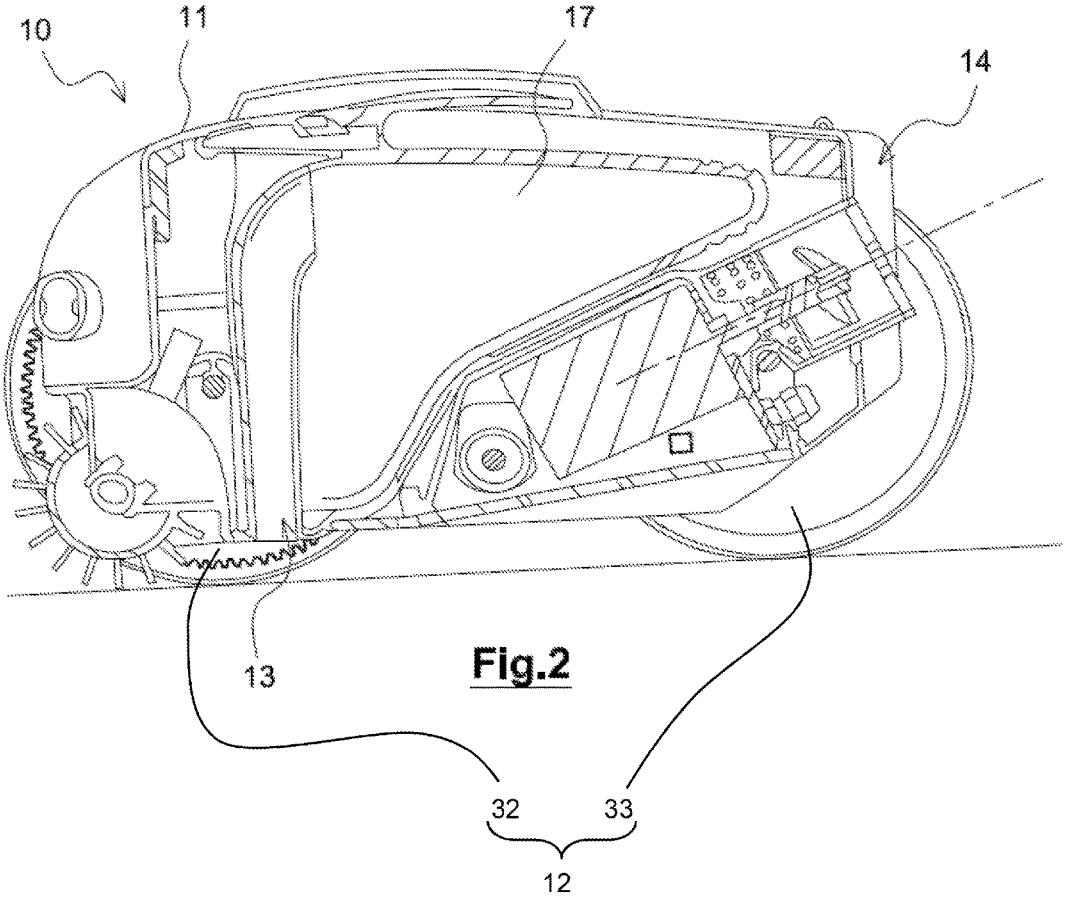
FIG. 2 shows another perspective view of the same device.
Figure 3:
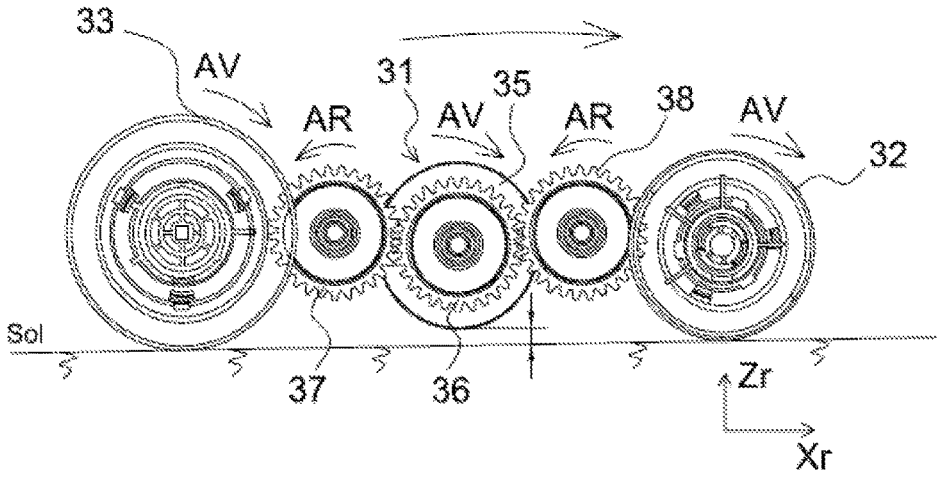
FIG. 3 shows a side view of the intermediate wheel and gears principle as described here.

FIGS. 1 and 2 show an embodiment of the cleaning device 10 described here by way of example.

In these figures, the device is here of the type ejecting water toward the rear of the device relative to the plane on which the device rolls. In another embodiment, the device ejects water towards the top of the device relative to the plane on which the robot rolls.

The swimming pool cleaning device includes a body 11 and means 12 for driving and guiding the body 11 over an immersed surface. In the present example the driving and guide means 12 consist of front wheels 32 and rear wheels 33 disposed laterally with respect to the body (see FIG. 1).

The drive and guide means define a guide plane on an immersed surface by their points of contact with said immersed surface. Said guide plane is generally substantially tangential to the immersed surface at the location of the device. Said guide plane is for example substantially horizontal when the device moves over a swimming pool bottom constituting the immersed surface. This kind of guide plane is defined in the figures of the present application relative to perpendicular axes Xr and Yr. It is referred to as the guide plane XrYr.

Throughout the text the concepts "high" and "low" are defined along a straight line segment perpendicular to said guide plane, a "low" element being closer to the guide plane than a high element.

The swimming pool cleaning device further includes a motor driving said driving and guide means, said motor being supplied with energy by the control and monitoring unit via a watertight flexible cable in the present example.

The swimming pool cleaning device includes at least one liquid inlet 13 and one liquid outlet 14. The liquid inlet 13 is situated at the base of the body (in other words on its underside), i.e. immediately faces an immersed surface over which the device moves in order to be able to aspirate debris that has accumulated on said immersed surface.

Here the liquid outlet 14 is situated on the lid at the rear of the device. In the present example, the liquid outlet is in a direction oriented toward the rear of the device. This arrangement is not limiting on the invention, however, and a water outlet substantially perpendicular to the guide plane, i.e. vertical if the cleaning device is resting on the bottom of the swimming pool, can equally well be envisaged.

The device includes a hydraulic circuit connecting the liquid inlet 13 to the liquid outlet 14. The hydraulic circuit is adapted to circulate liquid from the liquid inlet 13 to the liquid outlet 14. To this end the device includes a circulation pump including an electric motor and an impeller, said electric motor driving the impeller in rotation, said impeller being disposed in the hydraulic circuit.

The device includes a filter chamber 17 disposed in the hydraulic circuit between the liquid inlet 13 and the liquid outlet 14. The filter chamber is in particular fed with liquid via at least one upstream channel connecting the liquid inlet 13 to the filter chamber 17.

The filter chamber 17 contains a filter basket. This filter basket is advantageously although not necessarily removable.

As seen in FIGS. 3 to 7, in the present embodiment the drive means further include an intermediate wheel 31 disposed between the front wheel 32 and the rear wheel 33 on at least one of the two sides of the device.

Here this intermediate wheel 31 turns about a rotation axis 34 parallel to the transverse axis Yr, which corresponds to the drive axis of the front wheels 32 and the rear wheels 33. In a variant embodiment, this intermediate wheel 31 turns about a rotation axis that is not parallel to the transverse axis. In the present example, this rotation axis 34 is situated in the plane defined by the axes of the front and rear wheels, without this being a condition necessary for the device according to the invention to work.

Figure 4:
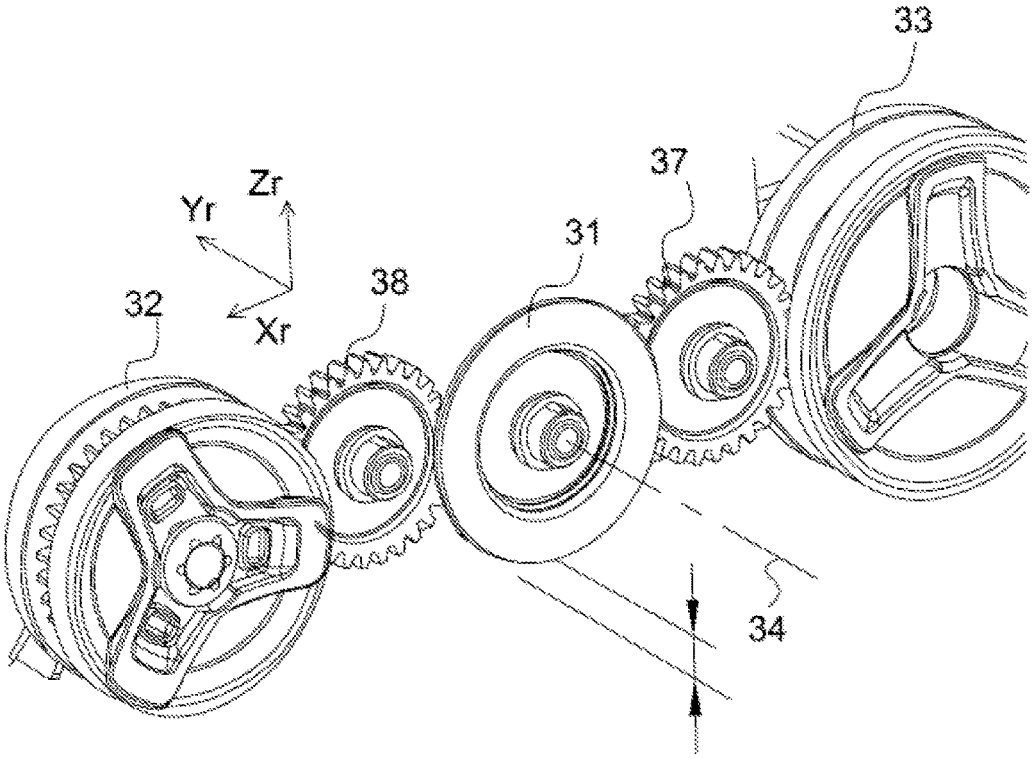
FIG. 4 shows a perspective view of the same device, as seen from outside the robot.
Figure 5:
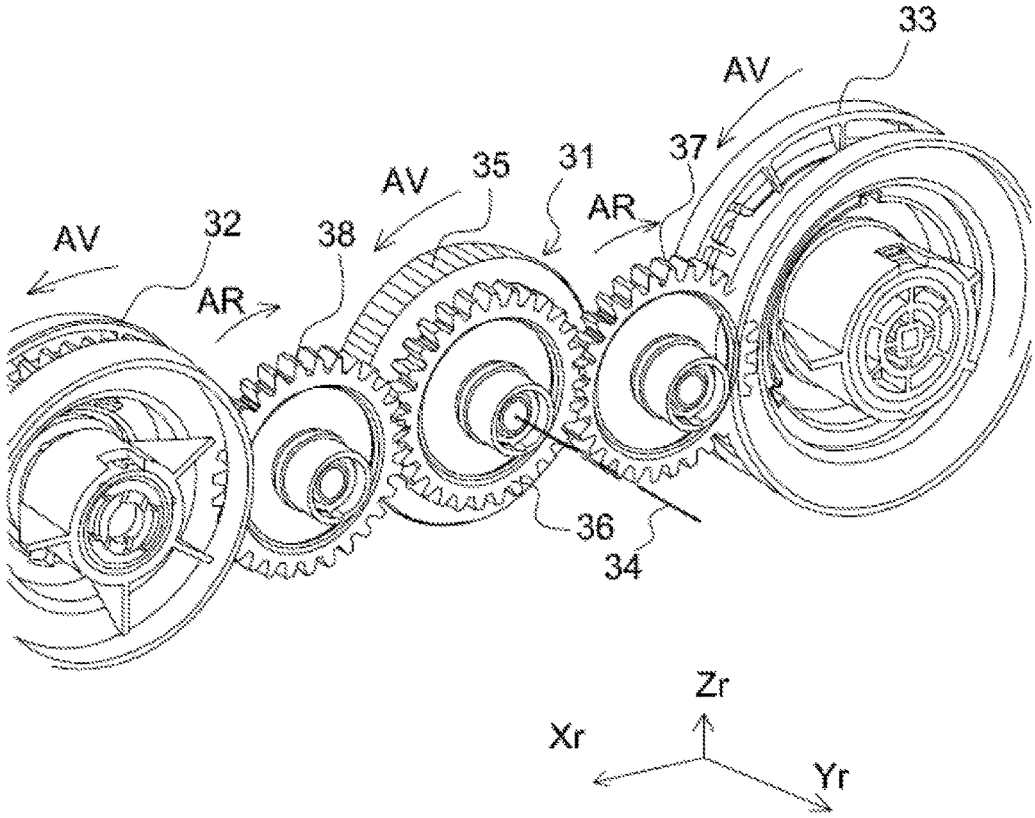
FIG. 5 shows a perspective view of the same device, as seen from inside the robot.
Figure 6:
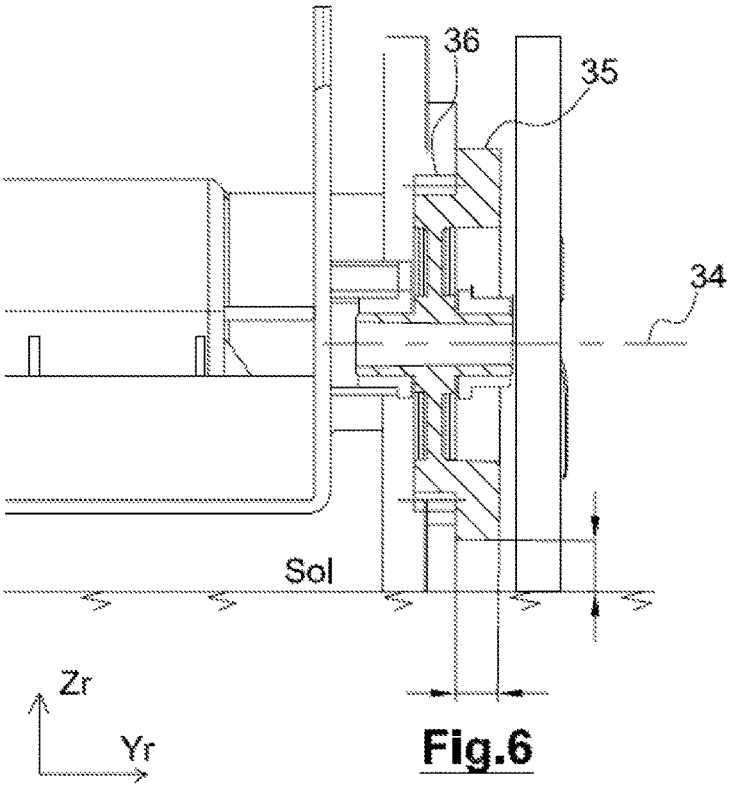
FIG. 6 shows a view of the intermediate wheel in section on a plane passing through its rotation axis.
Figure 7:
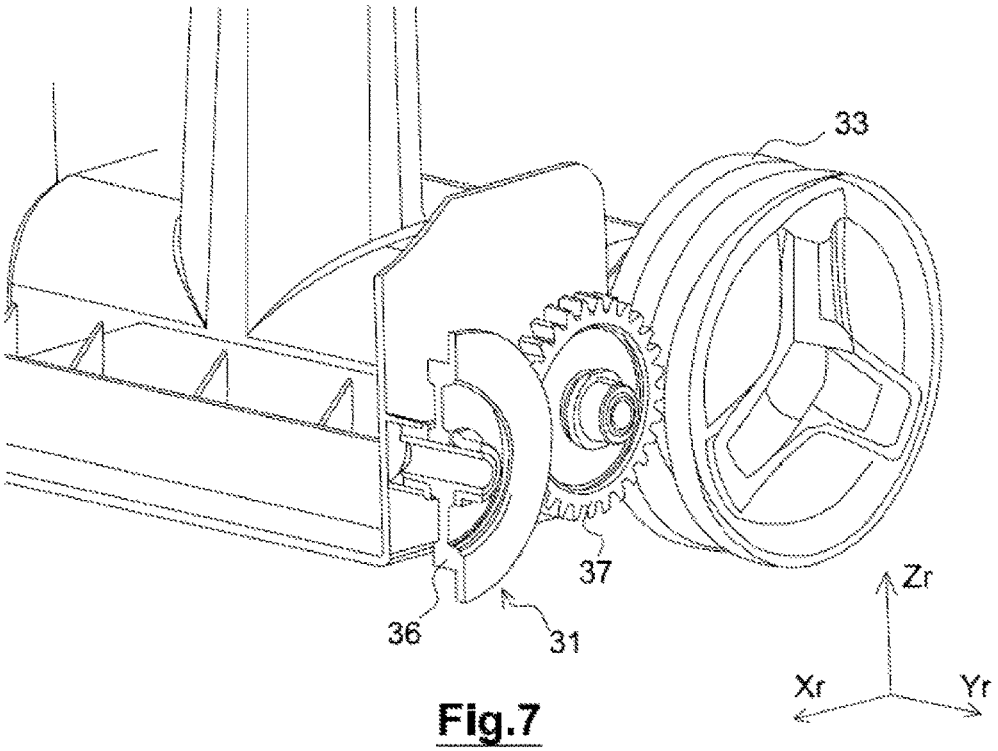
FIG. 7 shows a perspective view of the wheel in half-section showing its integration with the body of the robot.

As seen in FIG. 4 in particular, the diameter and the position of the rotation axis 34 of this intermediate wheel 31 are such that said wheel does not touch the guide plane XrYr when the robot is resting on the latter. The vertical offset between said guide plane XrYr and the bottom of the intermediate wheel 31 is approximately 2 centimeters here. This value is given here by way of illustration only, and other higher or lower values may be envisaged.

In the present embodiment, the intermediate wheel 31 is longitudinally situated practically halfway between the front wheels 32 and the rear wheels 33.

Here its diameter is slightly less than that of the front wheels 32, which is also less than that of the rear wheels 33.

The intermediate wheel 31 includes on its circumference a friction area 35 of substantially cylindrical shape having a non-slip surface state. Here the width of this friction area 35 is approximately 1 or 2 centimeters. This width and the material forming the adhesion area of the wheel depend on the type of ground over which the robot has to move.

Here the intermediate wheel 31 is driven in rotation thanks to an internal gear area 36 of smaller diameter than the friction area. This gear area 36 cooperates with a gear 37 driven by the rear wheels 33. In the same manner, the gear area 36 cooperates with a second gear 38 driven by the front wheels 32. Thus here the intermediate wheel 31 is driven indirectly by the motor driving the wheels.

The precise geometries and materials of these gears 37, 38 can easily be determined by a person skilled in the art according to the particular features of the cleaning robot concerned.

Clearly, by virtue of the disposition of the gears, the intermediate wheel 31 turns in the same direction as the front wheels 32 and the rear wheels 33. In the present embodiment, this intermediate wheel 31 has a rotation speed such that the tangential speed of the friction area 35 is substantially equal to that of the front wheels 32 and the rear wheels 33. It can also have a rotation speed such that the tangential speed of the friction area 35 is lower than that of the front wheels 32 and the rear wheels 33.

Operating Mode

When the cleaning device 10 is clearing an obstacle, one of the front wheels 32 or the rear wheels 33 is no longer in contact with the guide surface. In this case, a prior art robot has difficulty in moving.

On the other hand, in the situation described above, when the front wheel 32 (or the rear wheel 33) is no longer in contact with the guide surface because of the presence of an obstacle that has raised the front part of the cleaning device 10, the intermediate wheel 31 bears on the obstacle, rolls over the latter because it is driven by the motor of the device 10, and enables said cleaning device to clear this obstacle easily.

Variants

In a variant embodiment, the drive means of the cleaning device include an intermediate wheel 31 on each side of the body 11.

In another variant embodiment, the friction area 35 includes at least one projection forming a lug adapted to bear on an obstacle situated on the bottom of the swimming pool to facilitate the robot 10 clearing it. It may alternatively include a greater number of projections, for example three equi-angularly spaced projections.

In a further variant embodiment, the intermediate wheel 31 turns about an eccentric rotation axis 34, As a result, the distance between the guide plane and the intermediate wheel is not fixed, but varies as this wheel 31 rotates.

In a further variant embodiment, the intermediate wheel 31 is driven by the gears at a speed different from the front and rear wheels, for example such that the tangential speed of the friction area is twice the tangential speed of the front wheels 32 and the rear wheels 33 at their point of contact with the guide plane XrYr.

In a variant embodiment, the drive means of the cleaning device 10 include an intermediate wheel 31 on each side of the body 11, the intermediate wheels 31 having different diameters and/or rotation speeds.

The invention claimed is:

1. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel extending externally of the body and turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and the intermediate wheel is configured to bear on an obstacle protruding upward from the guide plan XrYr when the intermediate wheel contacts the obstacle.

2. The swimming pool cleaning device as claimed in claim 1, wherein the rotation axis is parallel to a transverse axis Yr, which corresponds to a drive axis of the front wheels and the rear wheels.

3. The swimming pool cleaning device as claimed in claim 2, wherein the rotation axis of the intermediate wheel is situated in a plane defined by the rotation axes of the front wheels and the rear wheels.

4. The swimming pool cleaning device as claimed in claim 1, wherein the intermediate wheel is longitudinally situated halfway between the front wheels and the rear wheels.

5. The swimming pool cleaning device as claimed in claim 1, wherein the intermediate wheel has a circumference including a substantially cylindrical friction area having a non-slip surface state.

6. The swimming pool cleaning device as claimed in claim 1, wherein the drive means of the cleaning device include an intermediate wheel on each side of the body.

7. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the rotation axis is not parallel to a transverse axis Yr, which corresponds to a drive axis of the front wheels and the rear wheels.

8. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, wherein the intermediate wheel has a circumference including a substantially cylindrical friction area having a non-slip surface state and wherein the friction area includes at least one projection forming a lug adapted to bear on an obstacle situated on the bottom of the swimming pool to facilitate said cleaning device clearing it.

9. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the intermediate wheel (a) has a circumference including a substantially cylindrical friction area having a non-slip surface state and (b) is driven in rotation thanks to an internal gear area of said intermediate wheel of smaller diameter than the friction area, this gear area cooperating with a gear driven by the rear wheels or the front wheels.

10. The swimming pool cleaning device as claimed in claim 9, wherein the gear area of the intermediate wheel cooperates with two gears, driven by the rear wheels and the front wheels.

11. The swimming pool cleaning device as claimed in claim 9, wherein the intermediate wheel is driven by the gears at a different speed than the front wheels and the rear wheels.

12. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the intermediate wheel (a) has a circumference including a substantially cylindrical friction area having a non-slip surface state and (b) turns in the same direction as the front wheels and the rear wheels, the intermediate wheel having a rotation speed such that the tangential speed of the friction area is substantially equal to that of the front wheels and the rear wheels.

13. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the intermediate wheel (a) has a circumference including a substantially cylindrical friction area having a non-slip surface state and (b) turns in the same direction as the front wheels and the rear wheels, the intermediate wheel having a rotation speed such that the tangential speed of the friction area is less than that of the front wheels and the rear wheels.

14. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the intermediate wheel turns eccentrically about the rotation axis.

15. A swimming pool cleaning device comprising:

a body comprising a liquid inlet for receiving debris-laden water, a liquid outlet, and a hydraulic circuit connecting the liquid inlet to the liquid outlet, and means for driving and guiding the body comprising at least two pairs of wheels: front wheels and rear wheels, wherein the drive means of the device further include:

an intermediate wheel turning about a rotation axis disposed between the front wheel and the rear wheel on at least one of the two sides of the device, the diameter and the position of the rotation axis of this intermediate wheel being such that the intermediate wheel does not touch the guide plane XrYr when the front and rear wheels are in contact with the guide plane XrYr, said guide plane XrYr being defined by the points of contact of the front and rear wheels with the ground, and wherein the drive means further include an intermediate wheel on each side of the body, the intermediate wheels having different diameters and/or rotation speeds.

16. A swimming pool cleaning device comprising:

a. a body comprising (i) a liquid inlet for receiving debris-laden water, (ii) a liquid outlet, and (iii) a hydraulic circuit connecting the liquid inlet to the liquid outlet; and b. means for driving the body at least along a generally horizontal surface at least when the body is upright, the driving means comprising:

i. a first front wheel extending externally of the body;

ii. a first rear wheel extending externally of the body; and iii. a first intermediate wheel (A) extending externally of the body and (B) configured to rotate about a first intermediate axis disposed between the first front wheel and the first rear wheel, with a position of the first intermediate axis being such that the first intermediate wheel (1) does not contact the generally horizontal surface when the first front wheel and the first rear wheel contact the generally horizontal surface and (2) is configured to bear on an obstacle protruding upward from the generally horizontal surface when the first intermediate wheel contacts the obstacle.

17. A swimming pool cleaning device according to claim 16 in which (a) the first front wheel is configured to rotate about a first front axis, (b) the first rear wheel is configured to rotate about a first rear axis, and (c) the first intermediate axis, the first front axis, and the first rear axis are disposed in the same horizontal plane when the body is upright.

18. A swimming pool cleaning device according to claim 16 in which the driving means further comprises:

a. a second front wheel extending externally of the body;

b. a second rear wheel extending externally of the body; and c. a second intermediate wheel (i) extending externally of the body and (ii) configured to rotate about a second intermediate axis disposed between the second front wheel and the second rear wheel, with a position of the second intermediate axis being such that the second intermediate wheel (A) does not contact the generally horizontal surface when the first and second front wheels and the first and second rear wheels contact the generally horizontal surface and (B) is configured to bear on an obstacle protruding upward from the generally horizontal surface when the second intermediate wheel contacts the obstacle.

* * * * *